US010641477B2

(12) United States Patent
Jenson et al.

(10) Patent No.: US 10,641,477 B2
(45) Date of Patent: May 5, 2020

(54) HIGH-BAY LUMINAIRE WITH HEAT-DISSIPATING HOUSING DEFINING A CAVITY WITH ANGLED INNER WALL

(71) Applicant: Hubbell Incorporated, Shelton, CT (US)

(72) Inventors: Taylor Jenson, Taylors, SC (US); Thomas Holscher, Simpsonville, SC (US); Joseph Engle, Taylors, SC (US)

(73) Assignee: Hubbell Incorporated, Shelton, CT (US)

( * ) Notice: Subject to any disclaimer, the term of this patent is extended or adjusted under 35 U.S.C. 154(b) by 90 days.

(21) Appl. No.: 15/969,189

(22) Filed: May 2, 2018

(65) Prior Publication Data

US 2018/0320882 A1 Nov. 8, 2018

Related U.S. Application Data

(60) Provisional application No. 62/502,003, filed on May 5, 2017.

(51) Int. Cl.

| | |
|---|---|
| ***F21S 8/04*** | (2006.01) |
| ***F21V 29/77*** | (2015.01) |
| ***F21V 23/00*** | (2015.01) |
| ***F21V 15/01*** | (2006.01) |
| ***F21V 29/508*** | (2015.01) |

(Continued)

(52) U.S. Cl.

CPC ..... *F21V 29/773* (2015.01); *F21V 15/01* (2013.01); *F21V 23/003* (2013.01); *F21V 23/007* (2013.01); *F21V 29/10* (2015.01); *F21V 29/508* (2015.01); *F21V 29/83* (2015.01); *F21V 3/02* (2013.01); *F21V 23/0471* (2013.01); *F21V 31/005* (2013.01); *F21Y 2115/10* (2016.08)

(58) Field of Classification Search

CPC ..... F21V 29/507; F21V 29/777; F21V 15/01; F21V 29/77; F21V 29/74; F21V 29/508; F21V 29/503; F21S 8/04

See application file for complete search history.

(56) References Cited

U.S. PATENT DOCUMENTS 7,824,077 B2 * 11/2010 Chen ..... F21V 23/009 362/294
7,959,332 B2 * 6/2011 Tickner ..... F21S 8/02 362/373

(Continued)

FOREIGN PATENT DOCUMENTS

WO 2012054966 5/2012

OTHER PUBLICATIONS

PCT/US2018/030630 International Search Report and Written Opinion dated Jul. 20, 2018 (18 pages).

*Primary Examiner* — Ismael Negron

(74) *Attorney, Agent, or Firm* — Michael Best & Friedrich, LLP

(57) ABSTRACT

A high-bay luminaire includes an upper housing having an outer wall with an interior surface defining an interior compartment, and outer wall with an angled portion extending at an oblique angle towards a center of the interior compartment; a plurality of first heat fins extending from the exterior surface of the outer wall; a base connected to the upper housing; a light emitter connected to the base; a lens connected to the base and positioned below the light emitter; and a driver connected to the angled portion and operatively connected to the light emitter.

20 Claims, 9 Drawing Sheets

(51) Int. Cl.

| | |
|---|---|
| ***F21V 29/83*** | (2015.01) |
| ***F21V 29/10*** | (2015.01) |
| *F21Y 115/10* | (2016.01) |
| *F21V 3/02* | (2006.01) |
| *F21V 23/04* | (2006.01) |
| *F21V 31/00* | (2006.01) |

(56) References Cited

U.S. PATENT DOCUMENTS

| | | | | |
|---|---|---|---|---|
| 8,007,143 | B2 * | 8/2011 | Liu | F21K 9/238 362/373 |
| 8,419,225 | B2 * | 4/2013 | Zeng | F21V 29/773 362/294 |
| 8,692,444 | B2 * | 4/2014 | Patel | F21V 3/02 313/46 |
| 8,931,921 | B2 * | 1/2015 | Kim | F21V 21/00 362/249.14 |
| 9,423,110 | B1 * | 8/2016 | Newton | F21S 8/00 |
| 9,581,323 | B2 * | 2/2017 | Shum | H05B 33/089 |
| 9,845,945 | B1 * | 12/2017 | Newton | F21S 8/00 |
| 2011/0228529 | A1 | 9/2011 | Patel et al. | |
| 2012/0063138 | A1 | 3/2012 | Leadford et al. | |
| 2012/0155077 | A1 * | 6/2012 | Kim | F21V 7/048 362/235 |
| 2012/0212945 | A1 * | 8/2012 | Frank | F21S 2/005 362/184 |
| 2014/0268789 | A1 * | 9/2014 | Boyer | F21V 21/14 362/267 |
| 2016/0131356 | A1 | 5/2016 | Engberg | |
| 2019/0203924 | A1 * | 7/2019 | Devappa | F21V 15/01 |

* cited by examiner

HIGH-BAY LUMINAIRE WITH HEAT-DISSIPATING HOUSING DEFINING A CAVITY WITH ANGLED INNER WALL

RELATED APPLICATION(S)

This application is based on U.S. Provisional Application Ser. No. 62/502,003, filed May 5, 2017, the disclosure of which is incorporated herein by reference in its entirety and to which priority is claimed.

FIELD

Various exemplary embodiments relate to light fixtures or luminaires, for example indoor high-bay luminaires used in commercial or industrial applications.

BACKGROUND

Light fixtures, or luminaires, are used with electric light sources to provide an aesthetic and functional housing in both interior and exterior lighting applications. For example, high bay luminaires can be used in larger open indoor environments such as heavy industrial settings, warehouses, gyms, churches, and shopping malls. Conventional high bay lighting fixtures for commercial and industrial applications are often mounted or suspended from ceiling joists high above the floor.

Recently, lighting fixtures have begun using light emitting diodes (LEDs) as a light source. The use of LEDs comes with unique light distribution and thermal management requirements for both the light emitters and the control components required to run the light fixtures. These considerations can lead to complex housing and heat dissipation designs in an attempt to balance performance and aesthetic characteristics.

SUMMARY

According to an exemplary embodiment, a high-bay luminaire includes an upper housing having an outer wall defining an interior compartment. A plurality of first heat fins extend from the exterior of the outer wall. An angled wall extends from the outer wall at an oblique angle toward the center of the interior compartment. A base is connected to the upper housing. A light emitter is connected to the base. A lens is connected to the base and positioned below the light emitter. A driver is connected to the angled wall and operatively connected to the light emitter.

According to another exemplary embodiment, a high-bay luminaire includes an upper housing having an outer wall defining an interior compartment. A plurality of first heat fins extend from the exterior of the outer wall. A first angled wall extends from the outer wall at an oblique angle toward the center of the interior compartment and a second angled wall extends from the outer wall at an oblique angle toward the center of the interior compartment. A base is connected to the upper housing. A light emitter is connected to the base. A lens is connected to the base and positioned below the light emitter. A driver bracket is positioned in the interior compartment and configured to retain a first driver against the first angled wall.

According to another exemplary embodiment, a high-bay luminaire includes an upper housing having a bottom wall and an outer wall defining an interior compartment. A plurality of first heat fins extend from the exterior of the outer wall. A base is connected to the upper housing. The base includes a plurality of second fins aligned with and spaced from the first fins and an inner section spaced from and facing the bottom wall. A light emitter is connected to the base. A lens is connected to the base and positioned below the light emitter. A driver is positioned in the interior compartment. An airflow channel is defined by the space between the bottom wall and the inner section and the space between the first fins and second fins.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
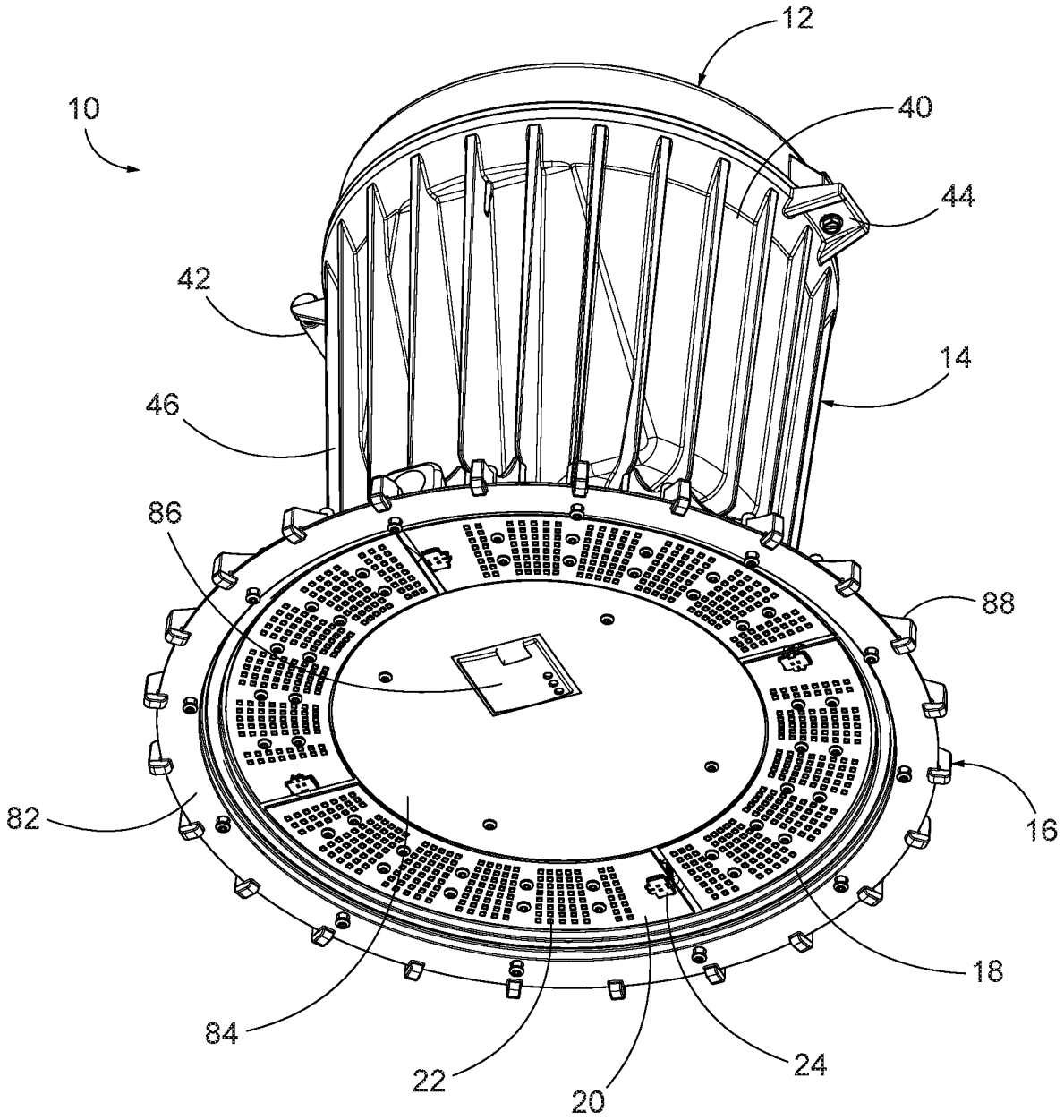
FIG. 1 is a bottom perspective view of an exemplary luminaire.

Various exemplary embodiments are directed to a high bay luminaire 10 having a cover 12, an upper housing 14, and base 16. The cover 12 is pivotally connected to the upper housing 14. The upper housing contains one or more control components. The control components can include different drivers, fuses, or surge protectors, as well as various types of sensors. Other control components can be associated with the luminaire, as would be understood by one of ordinary skill in the art. The base 14 receives a light emitter assembly 18 and one or more of the control components are operatively connected to the lighter emitter assembly 18 to control the light output therefrom.

In this exemplary embodiment, the light emitter assembly 18 includes four curved LED boards configured in a ring. The LED boards include a printed circuit board 20 with one or more LEDs and a connector 24. Other sizes, shapes, configurations, and types of light emitters can also be used.

Figure 2:
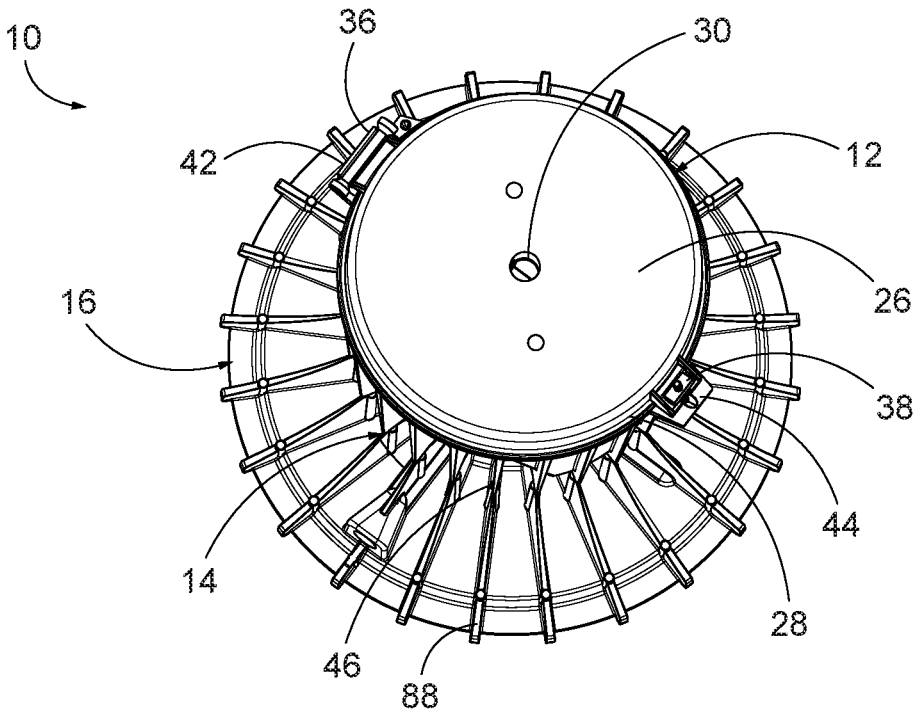
FIG. 2 is a top perspective view of FIG. 1.
Figure 3:
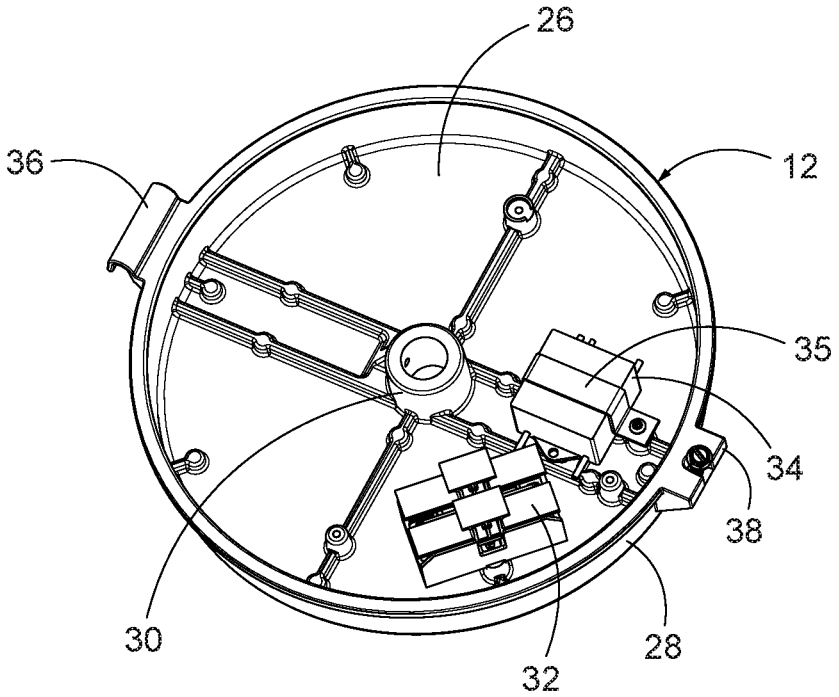
FIG. 3 is a bottom perspective view of the cover.

FIGS. 2 and 3 show an exemplary embodiment of the cover 12. The cover 12 has a substantially cylindrical configuration with a top wall 26, an open bottom, and a circular side wall 28. A central boss 30 defines a conduit extending through the top wall 26. The central conduit can receive a mounting component, such as a pendant or hook mount. The central boss 30 can include an interior thread or other connection feature. Mounting features are provided on the interior of the top wall 26 to connect one or more control components. The mounting features can include various openings or other features for receiving fasteners, straps, brackets, snap-fits, or other mechanical connectors. In the exemplary embodiment shown, a surge protector 32 and fuse assembly 34 are connected to the cover 12. The fuse assembly 34 is connected to the cover using a mounting bracket 35. A hinge member extends from a first side of cover 12. The hinge member includes a hook 36 that pivotally connects to the upper housing 14. The connection member extends from a second side of the cover. The connection member includes a tab 38 having a substantially U-shaped slot that can receive a fastener to secure the cover to the upper housing in a closed portion. A gasket can be positioned between the cover 12 and the upper housing 14.

Figure 4:
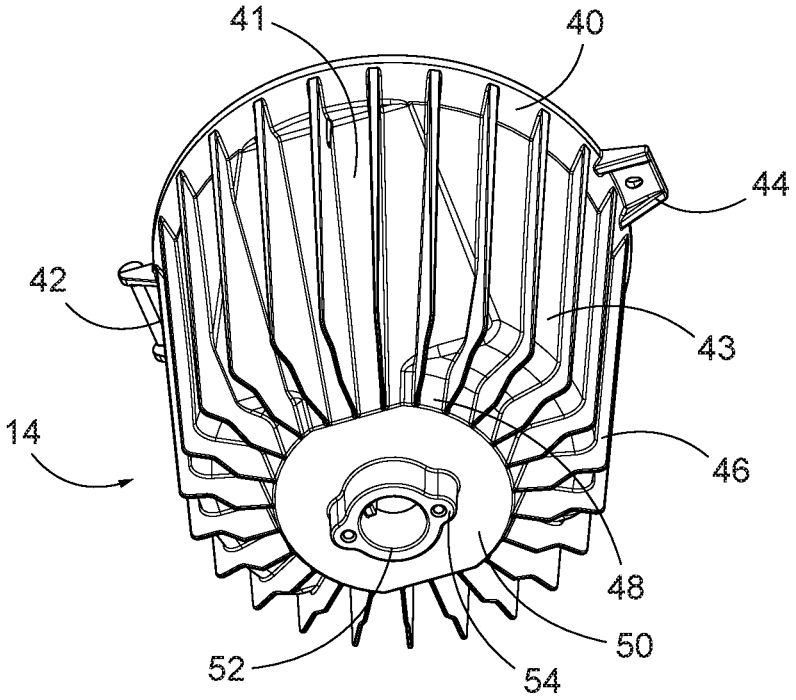
FIG. 4 is a bottom perspective view of the upper housing.
Figure 5:
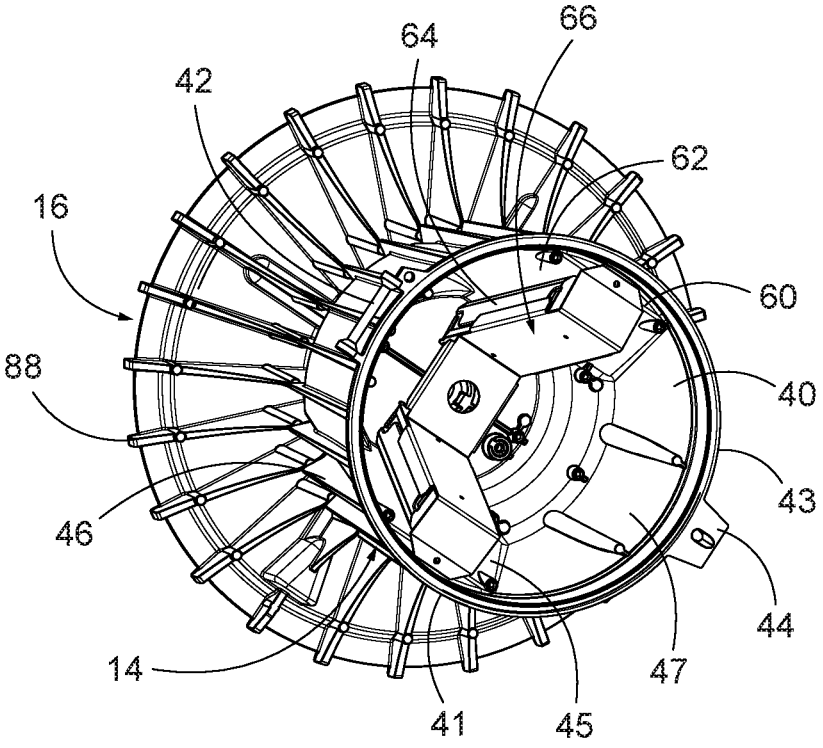
FIG. 5 is a top perspective view of the upper housing and base.

FIGS. 4 and 5 show an exemplary embodiment of the upper housing 14. The upper housing 14 includes an outer wall 40 defining an interior compartment. The exterior of the outer wall 40 includes opposite flat portions 41 and opposite rounded portions 43, with the flat portions 41 having a substantially trapezoidal cross-section. A hinge component and a connecting portion extend from opposite sides of the outer wall 40. The hinge component includes a cylindrical post 42 that pivotally connects to the hook member 36. The connecting portion includes a tab 44 having an opening to receive a fastener. A plurality of heat fins 46 extend from the outer wall 40. The upper housing 14 includes a narrowed lower portion 48 having a bottom wall 50. A flange 52 extends from the bottom wall 50 to connect to the base 12. A pair of bosses 54 are positioned adjacent the flange 52 to receive fasteners to connect the upper housing 14 to the base 16.

FIG. 5 shows the interior of the upper housing 14. The interior of the outer wall 40 includes opposite angled portions 45 corresponding to the exterior flat portions 41 and opposite interior curved portions 47 corresponding to the exterior curved portions 43. The angled portions 45 include an upper ledge 60 extending form the outer wall 40 into the interior compartment and an angled wall 62 that extends toward the center of the interior compartment as it extends toward the bottom wall 50. Each of the angled walls 62 can receive a driver 64. The drivers 64 can be connected to the angled walls 62 by a driver bracket 66.

Figure 6:
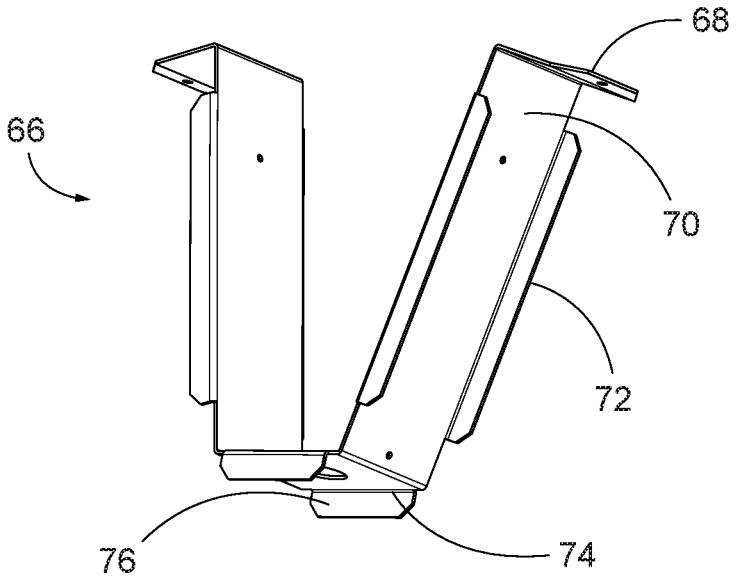
FIG. 6 is a perspective view of the driver bracket.

FIG. 6 shows an exemplary embodiment of the driver bracket 66. The driver bracket 66 has a substantially V-shaped configuration with a pair of upper flanges 68 that connects to the upper ledge 60. An angled side 70 extends from each of the upper flanges 68. A pair of first tabs 72 extend from each of the angled sides 70. The angled sides 70 meet at a lower wall 74. A pair of second tabs 76 extend from the lower wall 74. A central opening is provided in the lower wall 74. The central opening acts as a conduit for conductors connecting one or more of the control components, such as drivers, to the light emitter assembly 18.

Figure 7:
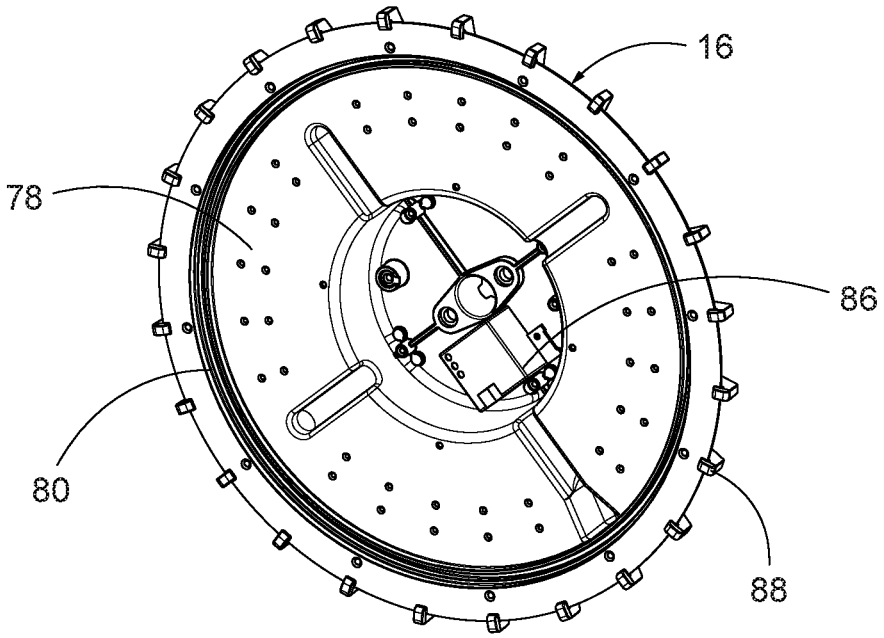
FIG. 7 is a bottom perspective view of the base.
Figure 13:
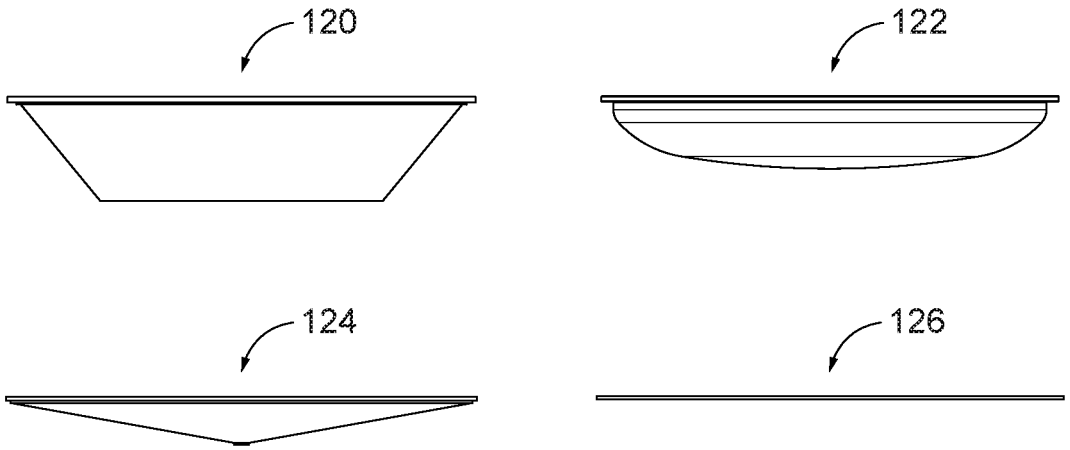
FIG. 13 is a side view of different lenses.

FIG. 7 shows the lower portion of the base 16 that includes a mounting area 78 for receiving the light emitter assembly 18. The mounting area 78 includes openings for receiving fasteners to connect the light boards, although other connections can also be used. A rim 80 is provided adjacent the mounting area to receive a lens mount 82. As shown in FIG. 1, the lens amount 82 is configured to attach a lens to the base 16. One or more openings are provided in the lens mount 82 for receiving fasteners to connect the lens mount 82 to the base 16. The lens mount 82 includes an inner rim and has a first side and a second side. The first or second side can alternatively face out from the luminaire to receive different lenses. FIG. 13 shows exemplary embodiments of a drop lens 120, a SAG lens 124, a conical drop lens 126, and a flat lens 128 that can be connected to the base 16. Other lenses or optical components can also be used. The base 16 includes a central recessed portion that can be covered by a plate 84. The recessed portion can house one or more control components, such as a sensor 86. The sensor can be an occupancy sensor or a light sensor that determines the ambient light and is used to adjust the light output from the light emitters 18. In some embodiments, a microwave motion sensor 86 is used. Other control components, such as the controllers or communication modules, can also be positioned in the recessed portion.

Figure 8:
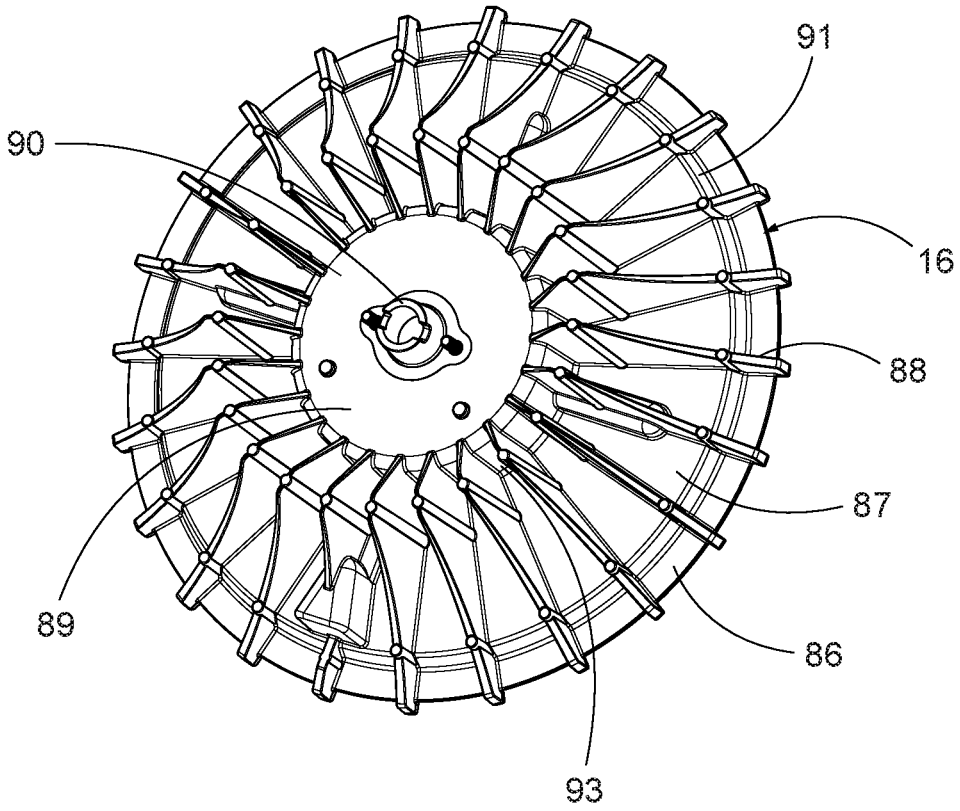
FIG. 8 is a top perspective view of the base.
Figure 9:
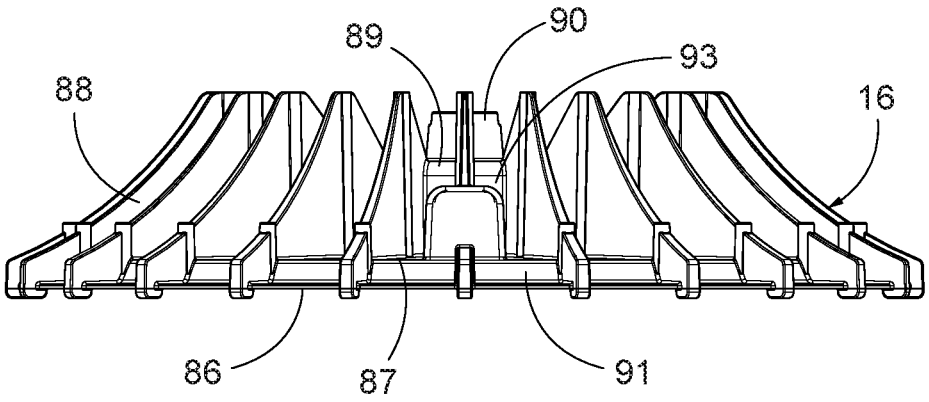
FIG. 9 is a side view of the base.

FIGS. 8 and 9 show an upper portion of the base 16. The base 16 includes an outer section 85, a middle section 87, and an inner section 89. In an exemplary embodiment the outer section 85, middle section 87, and the inner section 89 are vertically spaced from one another, with an angled transition 91 separating the outer section 85 and the middle section 87, and a raised wall 93 separating the middle section 87 and the inner section 89. A plurality of heat fins 88 extend from the outer section 85 to the inner section 89. The base heat fins 88 have a frusto-triangular cross-section and are configured to align with the heat fins 46 from the upper housing 14. A hub 90 extends from central region of the base 16. The hub 90 mates with the upper housing flange 52 to provide a conduit for conductors to extend from the upper housing 14 into the base 16 and connect to the light emitters 18 and any control components connected to the base 16. A gasket can be provided between the upper housing 14 and the base 16 to provide a water resistant seal.

Figure 10:
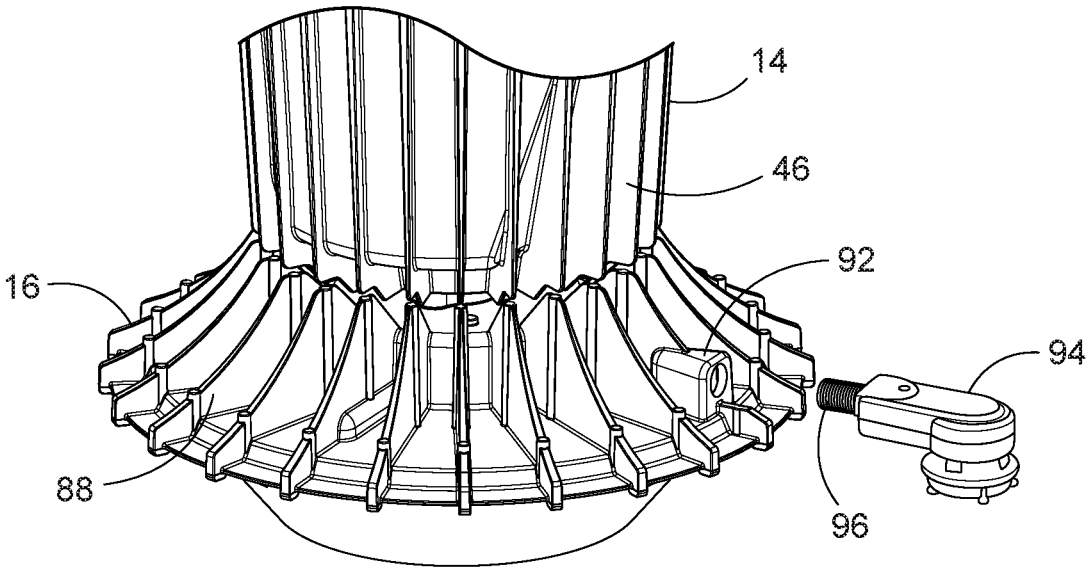
FIG. 10 is a side perspective view of the base and an external sensor.

FIG. 10 shows an exemplary embodiment of the base 16 having a mounting component 92 for receiving an external sensor 94. The mounting component 92 includes an enlarged housing positioned in one of the fins 88. The sensor 94 includes a threaded shaft 96 that can receive a fastener, for example a nut or threaded washer, to connect the sensor 94 to the base 16. In some exemplary embodiments, the sensor 94 is a passive infrared (PIR) sensor.

Figure 11:
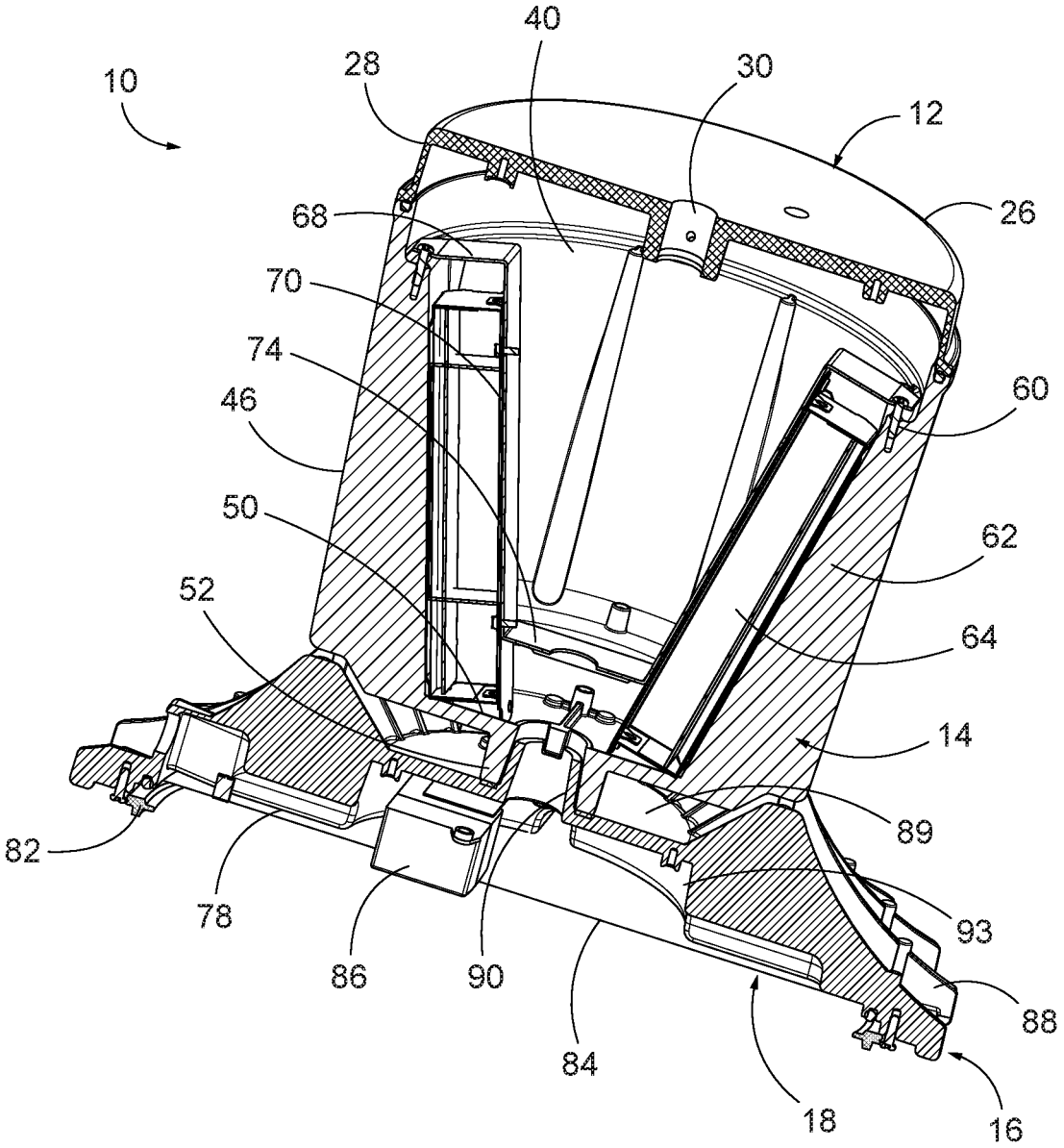
FIG. 11 is a sectional view of FIG. 1.

FIG. 11 shows a sectional view of the assembled high-bay luminaire. In certain embodiments, the luminaire is configured to have a light output of approximately 24 k lumens. The position of the driver brackets on the angled walls helps to dissipate heat generated by the drivers. The spacing in the fins and the separation between the upper housing and the base helps thermally isolate the light emitters from the drivers and to allow for air-flow between the two sections. For example, an airflow channel can be provided between the upper housing 14 and the base 16. For example a space is defined between the bottom wall 50 of the upper housing 14 and the inner section 89 of the base 16 and between the upper housing heat fins 46 and the base heat fins 88. The airflow channel can act as an at least partial thermal barrier between the upper housing 14 and the base 16.

Figure 12:
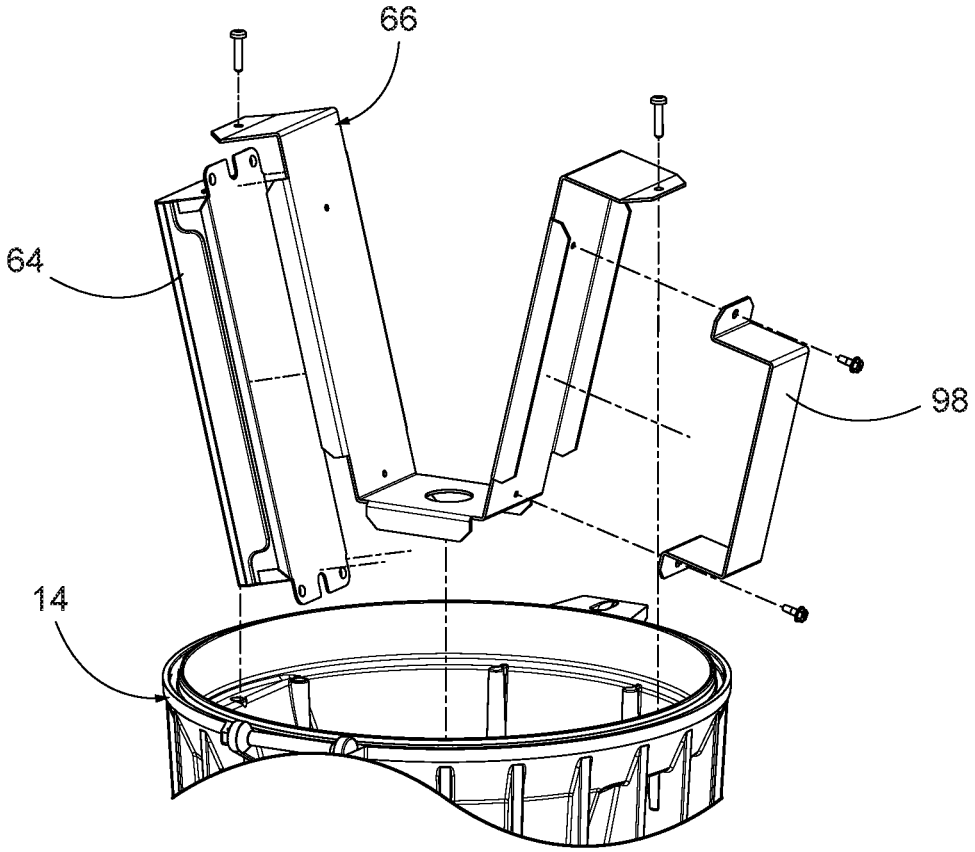
FIG. 12 is a partial view of an alternative driver configuration.

FIG. 12 shows an exemplary embodiment of an assembly for a single driver configuration that can be used to produce a lower light output, for example 12 k. A secondary bracket 98 can be connected to the driver bracket 66 to provide spacing and support against the angled wall 62. In place of the secondary bracket 98, a dummy driver or other form of ballast can be used to balance the weight in the upper housing.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A high-bay luminaire comprising:

an upper housing having an outer wall including an exterior surface and an interior surface, the interior surface defining an interior compartment, and a plurality of first heat fins extending from the exterior surface, wherein an angled portion of the outer wall extends at an oblique angle toward the center of the interior compartment;

a base connected to the upper housing;

a light emitter connected to the base;

a lens connected to the base and positioned below the light emitter; and a driver connected to the angled portion and operatively connected to the light emitter.

2. The high-bay luminaire of claim 1, wherein the base includes a plurality of second fins aligned with the first fins.

3. The high-bay luminaire of claim 1, wherein the upper housing includes a bottom wall and a flange extending from the bottom wall, and the base includes a hub extending from an inner portion to mate with the flange.

4. The high-bay luminaire of claim 1, wherein an airflow channel is defined between the upper housing and the base to reduce heat transfer between the upper housing and the base.

5. The high-bay luminaire of claim 1, wherein the driver is connected to the angled portion by a driver bracket.

6. The high-bay luminaire of claim 5, wherein the driver bracket has a substantially V-shaped configuration including a first side and a second side connected to a lower wall, and wherein the driver is positioned by the first side.

7. The high-bay luminaire of claim 6, wherein a second driver is positioned by the second side.

8. A high-bay luminaire comprising:

an upper housing having an outer wall including an exterior surface and an interior surface, the interior surface defining an interior compartment, and a plurality of first heat fins extending from the exterior surface, the outer wall also including a first angled portion extending at an oblique angle toward the center of the interior compartment and a second angled portion extending at an oblique angle toward the center of the interior compartment;

a base connected to the upper housing;

a light emitter connected to the base;

a lens connected to the base and positioned below the light emitter; and a driver bracket positioned in the interior compartment and configured to retain a first driver against the first angled portion.

9. The high-bay luminaire of claim 8, further comprising a sensor removably connected to and extending from the base.

10. The high-bay luminaire of claim 8, wherein the driver bracket includes a lower wall, a first side extending from the lower wall at an oblique angle and a second side extending from the lower wall at an oblique angle.

11. The high-bay luminaire of claim 10, wherein a first ledge extends from the first angled portion and a second ledge extends from the second angled portion, and wherein a first flange extends from the first side and a second flange extends from the second side, and wherein the first tab engages the first ledge and the second tab engages the second ledge.

12. The high-bay luminaire of claim 10, wherein a pair of tabs extend from the first side toward the first angled portion.

13. The high-bay luminaire of claim 8, wherein a first driver is retained against the first angled portion by the driver bracket.

14. The high-bay luminaire of claim 13, wherein a spacer is connected to the second side of the driver bracket.

15. The high-bay luminaire of claim 13, wherein a second driver is retained against the second angled portion by the driver bracket.

16. A high-bay luminaire comprising:

an upper housing having a bottom wall and an outer wall defining an interior compartment, wherein a plurality of first heat fins extend from an exterior surface of the outer wall;

a base connected to the upper housing, the base includes a plurality of second fins aligned with and separated from the first fins to define a first space, and an inner section facing but separated from the bottom wall to define a second space;

a light emitter connected to the base;

a lens connected to the base and positioned below the light emitter; and a driver positioned in the interior compartment, wherein an airflow channel is defined by the first and second spaces.

17. The high-bay luminaire of claim 16, wherein a flange extends from the bottom wall and a hub extends from an inner portion to mate with the flange.

18. The high-bay luminaire of claim 16, wherein the upper housing includes an angled wall extending from the outer wall at an oblique angle toward the center of the interior compartment, and wherein a driver bracket having substantially V-shaped configuration retains the driver against the angled wall.

19. The high-bay luminaire of claim 16, wherein the base includes an outer section and a middle section positioned between the outer section and the inner section, and wherein the outer section, middle section, and inner section are spaced vertically from each other.

20. The high-bay luminaire of claim 19, wherein the second fins extend from an outer edge of the inner section to the outer section.

* * * * *